US005343805A

United States Patent [19]

Lövenbrant et al.

[11] Patent Number: 5,343,805

[45] Date of Patent: Sep. 6, 1994

[54] APPARATUS FOR INK SUPPLY

[75] Inventors: Jan Lövenbrant, Lomma; Alvar Olsson, Dalby, both of Sweden

[73] Assignee: Tetra Laval Holdings & Finance S.A., Pully, Switzerland

[21] Appl. No.: 872,010

[22] Filed: Apr. 22, 1992

[30] Foreign Application Priority Data

May 17, 1991 [SE] Sweden ..... 9101497-7

[51] Int. Cl.[5] ..... B41F 31/02

[52] U.S. Cl. ..... 101/366; 101/DIG. 34; 101/364; 101/210; 101/157; 101/169

[58] Field of Search ..... 101/366, 364, 363, 157, 101/169, DIG. 34, 208, 210; 417/404, 534, 491

[56] References Cited

U.S. PATENT DOCUMENTS

| | | | |
|---|---|---|---|
| 1,642,809 | 9/1927 | Granger | 101/366 |
| 2,447,090 | 8/1948 | Pollock | 101/169 |
| 3,108,539 | 10/1963 | Champion et al. | 101/169 |
| 3,390,831 | 12/1966 | Eaton, Jr. | 417/534 |
| 3,987,727 | 10/1976 | Thatcher | 101/366 |
| 4,625,643 | 12/1986 | Davis | 101/363 |
| 4,998,475 | 3/1991 | John et al. | 101/366 |
| 5,088,402 | 2/1992 | Hycner et al. | 101/366 |

FOREIGN PATENT DOCUMENTS

| | | | |
|---|---|---|---|
| 1062956 | 9/1979 | Canada | 101/366 |
| 0359958 | 3/1990 | European Pat. Off. . | |
| 684277 | 3/1941 | Fed. Rep. of Germany . | |
| WO89/07047 | 8/1989 | PCT Int'l Appl. . | |

*Primary Examiner*—Edgar S. Burr
*Assistant Examiner*—Lynn D. Hendrickson
*Attorney, Agent, or Firm*—Burns, Doane, Swecker & Mathis

[57] ABSTRACT

In an ink supply apparatus, inks of a paste-like consistency are supplied from a cylinder to a chamber doctor blade disposed adjacent an inking roller. Two conduits are disposed at opposite ends of the chamber doctor blade and each conduit communicates with one of the two opposite ends of the cylinder. Ink is supplied to the cylinder through an aperture. Within the cylinder there is disposed a reciprocating piston which, at low speed, forces ink via the conduits to the chamber doctor blade.

5 Claims, 1 Drawing Sheet

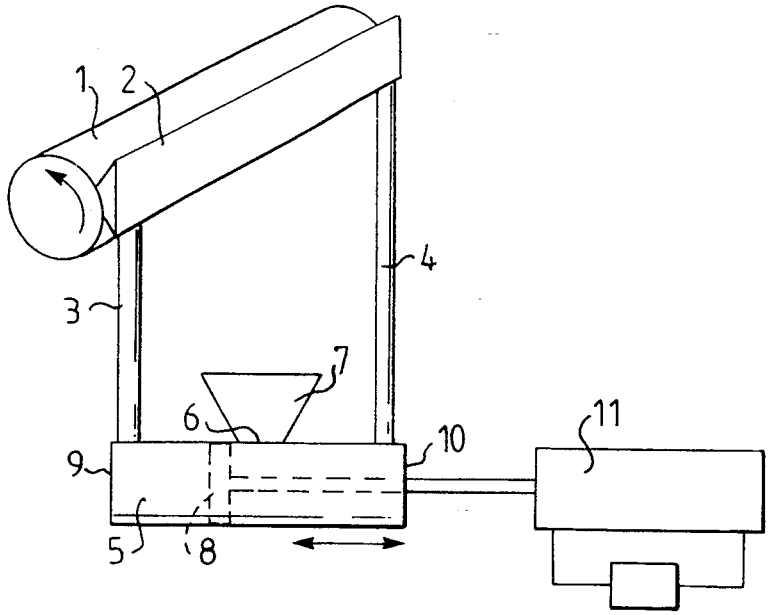
1
2
3
4
5
6
7
8
9
10
11

APPARATUS FOR INK SUPPLY

TECHNICAL FIELD

The present invention relates to an apparatus for ink supply on printing by means of a rotary printing process, the apparatus including an inking roller adjacent which is disposed a chamber doctor blade.

BACKGROUND ART

In printing by means of rotary printing processes such as flexograph, rotogravure or offset printing, different inks have been produced and, in addition, different ink supply systems. However, on occasions it proves desirable to employ, in one printing process, an ink which is actually intended for a different process. In such an instance, the ink supply system which has been developed for the ink and printing process in question will not function. For example, it is possible thus to employ a conventional inking roller for flexograph printing and, in addition, inks which are normally employed in offset printing. These inks have a paste-like viscous consistency and, as a result, by no means correspond to the more freely-flowing inks which are normally used in the flexograph printing process. One reason for wishing to employ offset inks in flexograph printing may be because the intention is to utilize screen printing (also known as raster print) in which the ink is not of the blanket type. Since flexograph inks are normally of the blanket type, these cannot be employed for this purpose. It has also proved possible to achieve improved print quality by combining different printing systems with inks intended for other printing systems.

One method of supplying viscous ink to a conventional flexograph inking roller is to pump the ink into a chamber doctor blade. However, a solution of this type would entail such low speeds of the pump that this would become extremely difficult to operate.

OBJECTS OF THE INVENTION

One object of the present invention is to realize an ink supply system in which it is possible to employ paste-like inks normally intended for offset printing in a printing process in which conventional flexograph printing rollers are utilized, with a chamber doctor blade disposed adjacent thereto.

A further object of the present invention is to realize an apparatus for ink supply which is easy to control and easy to regulate, with few moving parts.

Yet a further object of the present invention is to realize an apparatus for ink supply which is simple and easy to clean, and in which the ink is affected by mechanical action to but an insignificant degree.

In accordance with one aspect of the present invention, an apparatus for supplying ink to an inking roller is provided. The apparatus includes a cylinder having a reciprocating piston therein, the cylinder having first and second ends and an aperture between the ends for receiving ink. The apparatus further includes a doctor blade having a chamber for containing ink. A first conduit connects the first end of the cylinder to the chamber of the doctor blade. A second conduit connects the second end of the cylinder to the chamber of the doctor blade. The first and second conduits are connected with the chamber at spaced apart locations. Means are provided for reciprocating the piston between the first and second ends of the cylinder. Ink flows from the cylinder to the chamber when the reciprocating means moves the piston toward an end of the cylinder.

BRIEF DESCRIPTION OF THE ACCOMPANYING DRAWING

One preferred embodiment of the present invention will now be described in greater detail hereinbelow, with particular reference to the accompanying Drawing: FIG. 1 which schematically illustrates the apparatus according to the present invention.

The accompanying Drawing shows only those details essential to an understanding of the present invention, remaining parts of the printing press which are well-known to a person skilled in this art having been omitted.

DESCRIPTION OF PREFERRED EMBODIMENT

As shown in FIG. 1, a conventional chamber doctor blade 2 is disposed adjacent a conventional flexograph inking roller 1, the doctor blade normally being employed in flexograph printing processes. The chamber doctor blade 2 constitutes an enclosed chamber which abuts against the inking roller 1 with two sides and in which a third side closes the chamber outwardly. The chamber doctor blade 2 is also provided with end walls so that ink is completely enclosed in the chamber which is thus created.

At each end of the chamber doctor blade 2, there are provided connections which are of relatively large diameter, of the order of between 10 and 20 mm. A hose 3, 4 or conduit is joined to each connection, the hose or conduit having a diameter of between 10 and 20 mm. The two connections with their hoses 3, 4 are interconnected to each end of a cylinder 5. The connections of this cylinder 5 are also of relatively large diameter, of the order of between 10 and 20 mm. The cylinder 5 is provided with some form of aperture 6 where ink may be fed in. This aperture 6 is preferably disposed centrally of and above the cylinder 5. The aperture 6 may be designed as a funnel 7 with or without a lid, but other methods of supplying ink are also conceivable, such as continuous supply from an ink reservoir.

Within the cylinder 5, there is disposed a piston 8 which may reciprocate in the cylinder 5 between two end positions 9, 10. The piston 8 is ideally controlled by a pneumatic piston and cylinder assembly 11. The piston may also be controlled by an electric system. However, an electric system would be more complicated and, in the preferred embodiments of the present invention, the piston 8 is therefore controlled pneumatically.

Since the ink supply apparatus according to the present invention is to supply the flexograph inking roller 1 with a paste-like viscous ink of the offset ink type, the system must always be well-filled with ink in order to obtain an even and superior print quality. The ink is supplied via the aperture 6 of the cylinder 5, and, in one or other direction of its reciprocating movement, the piston 8 forces the ink up towards the chamber doctor blade 2 through the one conduit or hose 3. Excess ink returns via the other conduit 4 to the cylinder 5 and thus wholly fills the system. When the reciprocating piston 8 disposed in the cylinder has reached its one end position 9, it automatically reverses and moves back to its other end position 10. The ink then passes via the conduit 4 up to the chamber doctor blade 2 and excess ink returns to the cylinder 5 via the conduit 3.

Because of the consistency of the ink and the slight quantity of ink which is consumed in this printing process, the speed of displacement of the piston 8 must be very slow. This speed is dependent upon ink consumption and, thereby, also the width of the printing press mechanism. On the slow movement of the piston 8, that air which is entrapped in the system will have time to bleed out via the small openings which always naturally occur in such a system, since it is not possible to render such a system fully air tight. The slow movement of the piston 8 also entails that the ink will be treated very gently, given that the viscous offset printing inks may be highly sensitive to mechanical action.

When the ink supply apparatus is started up, a slightly higher speed for the first stroke of the piston 8 is conceivable, in order more rapidly to be able to prime the system fully, since it is important that the system is constantly full so as to ensure a satisfactory ink deposition on the inking roller 1. The pressure over the system will be quite low, given the slow movements executed by the piston 8, and a desirable pressure is of the order of between 0.1 and 0.3 bar.

In order to make the ink supply apparatus as easily maintained and simple to clean as possible, the cylinder 5 should be disposed as close to the inking roller 1 as possible, so as thereby to avoid the use of long conduits or hoses 3, 4 between the chamber doctor blade 2 and the ink cylinder 5. The relatively large diameter of the connections and conduits 3, 4 also makes for simple cleaning of the apparatus. By employing short conduits 3, 4, ink wastage in completed printing will also be minimized.

As will have been apparent from the above description, the present invention realizes an apparatus which makes possible ink supply to a conventional flexograph inking roller of a paste-like ink actually intended for offset printing processes. The apparatus makes for a system which is easy to clean and easy to control.

The present invention should not be considered as restricted to that described above and shown on the Drawing, many modifications being conceivable without departing from the spirit and scope of the appended claims.

What we claim and desire to secure by Letters Patent is:

1. An apparatus for supplying ink to an inking roller, comprising:

a cylinder having a reciprocating piston therein, the cylinder having first and second ends and an aperture between the ends for receiving ink;

a doctor blade having a chamber for containing ink;

a first conduit connecting the first end of the cylinder to the chamber of the doctor blade;

a second conduit connecting the second end of the cylinder to the chamber of the doctor blade, said first and second conduits being connected with the chamber at spaced apart locations;

means for reciprocating the piston between the first and second ends of the cylinder;

whereby ink flows from the cylinder to the chamber when the reciprocating means moves the piston toward an end of the cylinder.

2. The apparatus set forth in claim 1, wherein the reciprocating means includes a pneumatic piston and cylinder.

3. The apparatus set forth in claim 1, wherein an average pressure distribution throughout the apparatus is between 0.1 and 0.3 bars.

4. The apparatus set forth in claim 1, wherein the first and second conduits are between 10 and 20 mm in diameter.

5. The apparatus set forth in claim 1, wherein ink is supplied into the cylinder through a funnel in the aperture.

* * * * *